US005118032A

United States Patent [19]

Geho

[11] Patent Number: 5,118,032

[45] Date of Patent: Jun. 2, 1992

[54] CONTAINER AND BLANK FOR A FLAT FOOD PRODUCT

[75] Inventor: Kevin L. Geho, Louisville, Ky.

[73] Assignee: Chesapeake Packaging Company, Richmond, Va.

[21] Appl. No.: 606,022

[22] Filed: Oct. 30, 1990

[51] Int. Cl.[5] ..... B65D 5/30

[52] U.S. Cl. ..... 229/110; 229/120; 229/150; 229/195

[58] Field of Search ..... 229/110, 141, 142, 148, 229/149, DIG. 14, 906, 120, 150, 186, 188, 195

[56] References Cited

U.S. PATENT DOCUMENTS

| | | | |
|---|---|---|---|
| D. 274,889 | 7/1984 | Sullivan | D9/426 |
| D. 292,176 | 10/1987 | Kuerti | D9/428 |
| D. 306,405 | 3/1990 | Kuerti | D9/424 |
| D. 307,243 | 4/1990 | Baker | D9/426 |
| 643,366 | 2/1900 | Stecher | 229/149 |
| 1,810,956 | 6/1931 | Frankenstein | 229/150 |
| 2,358,943 | 9/1944 | Smith | 229/150 |
| 3,064,877 | 11/1962 | Forrer et al. | 229/150 |
| 3,163,344 | 12/1964 | Tunick | 229/16 |
| 3,428,103 | 2/1969 | Walsh | 150/2.2 |
| 3,442,433 | 5/1969 | Lombardi et al. | 229/2.5 |
| 3,512,697 | 5/1970 | Robinson | 229/39 |
| 3,633,815 | 1/1972 | Rosenburg, Jr. | 229/110 |
| 3,650,383 | 3/1972 | Nigro | 206/45.31 |
| 3,721,803 | 3/1973 | DiStefano | 219/387 |
| 3,923,234 | 12/1975 | Lund, Jr. | 229/37 E |
| 3,966,112 | 6/1976 | Gordon | 229/100 |
| 3,998,379 | 12/1976 | Myers et al. | 229/150 |
| 4,083,487 | 4/1978 | Zattoni | 229/150 |
| 4,180,200 | 12/1979 | Wilkinson, Sr. | 229/114 |
| 4,195,746 | 4/1980 | Cottrell | 220/4 E |
| 4,201,301 | 5/1980 | Aggio | 206/507 |
| 4,265,393 | 5/1981 | Orchard | 229/149 |
| 4,355,757 | 10/1982 | Roccaforte | 229/33 |
| 4,360,107 | 11/1982 | Roccaforte | 206/626 |
| 4,360,118 | 11/1982 | Stern | 220/4 E |
| 4,373,636 | 2/1983 | Hoffman | 206/551 |
| 4,376,558 | 3/1983 | Bandar | 312/259 |
| 4,441,626 | 4/1984 | Hall | 220/443 |
| 4,476,989 | 10/1984 | Larsen | 220/4 E |
| 4,567,341 | 1/1986 | Brown | 219/10.55 E |
| 4,620,666 | 11/1986 | Lacasa et al. | 229/149 |
| 4,687,130 | 8/1987 | Beeler | 229/149 |
| 4,765,534 | 8/1988 | Zion et al. | 229/109 |
| 4,819,862 | 4/1989 | Maroszek | 229/125.27 |
| 4,836,383 | 6/1989 | Gordon et al. | 206/611 |
| 4,848,543 | 7/1989 | Doboze | 206/45.32 |
| 4,877,609 | 10/1989 | Beck et al. | 426/87 |
| 4,883,195 | 11/1989 | Ott et al. | 220/339 |
| 4,886,179 | 12/1989 | Volk | 220/23.4 |
| 4,891,482 | 1/1990 | Jaeger et al. | 219/10.55 E |
| 4,919,326 | 4/1990 | Deiger | 229/109 |
| 4,922,626 | 5/1990 | Fiddler | 34/80 |

*Primary Examiner*—Stephen Marcus
*Assistant Examiner*—Christopher McDonald
*Attorney, Agent, or Firm*—Joseph G. Seeber

[57] ABSTRACT

A container for a flat food product is formed from a one-piece blank to provide a multisided container having a front panel, first and second opposing side panels, third and fourth opposing side panels, first and second perforated portions interconnecting said first and third opposing side panels and said second and fourth opposing side panels, respectively, a rear panel, and a top. The six-sided design provides less air space in the container, thus contributing to the maintenance of the temperature of the food product contained therein. Lock tabs located on minor flaps of the front panel secure the first and second opposing side panels into an upright position by interlocking under portions of the side panels. The perforated portions provide continuity between the side panels, and automatically provide hot air ventilation outlets when the container is assembled. The third and fourth opposing side panels are angle cut at their rear edges so as to achieve friction-locking of the side panels into place when the container is closed. The top rests on the side panels so as to prevent sagging and undesired contact with the food product contained within. Finally, tab-like portions provided on opposing sides of the top are inserted into the aforementioned slits to secure the top in a closed position.

33 Claims, 2 Drawing Sheets

CONTAINER AND BLANK FOR A FLAT FOOD PRODUCT

DESCRIPTION

1. Technical Field

The present invention generally relates to a container and corresponding blank suitable for packaging of flat food products, such as pizza pies, and more particularly to a six-sided container having a unique design which provides less airspace in the container than in conventional containers. Other characteristics of the container include a "lock tab" feature which maintains the side panels in an upright position relative to the base, the provision of hot air ventilation outlets which are automatically formed when the container is set up, and other features which cause the container to be securely closed.

2. Background Art

Containers for packaging flat food products, such as cakes, pies, pizza pies and the like, are well-known in the art, and have existed in a number of types and shapes. One conventional flat food product container comprises a shallow carton or container configured in a square or rectangular shape. Such conventional containers have various disadvantages, among which are the tendency of the wide tops or bottoms of such containers to deflect and contact the food product contained therein, the tendency of the sides of the container to be unsupported or unsecured so as to permit the food product to shift inadvertently within the container, and relatively poor pricing of such containers.

Octagonal containers have been developed in order to avoid the crushing or deflecting of container tops and bottoms typical of the rectangular containers discussed above. U.S. Pat. No. 4,765,534 - Zion et al discloses such an octagonal container. However, such octagonal containers are characterized by various disadvantages. For example, such containers do not generally provide the capability, or at least an easy and effective capability, of securing or locking the side panels of the container into an upright position relative to the base of the container during assembly of the container, thereby allowing the flat food product to be placed into the base of the container prior to closing of the container. In addition, such octagonal containers provide an excess of airspace within the container, thereby deterring users in their attempts to maintain the temperature of a hot food product for a reasonable period of time after the hot food product is placed in the container. Finally, such containers are typically not securely closed.

Thus, it would be desirable to provide a container having less airspace than the conventional octagonal container, and having a "lock tab" feature which is easily employed by the user during assembly of the container to secure or lock the side panels into an upright position relative to the base of the container. It would also be desirable to provide such a container with hot air ventilation outlets which are automatically formed as the container is assembled, to provide such a container with a top which is securely closed and which rests upon the sides of the base so as to resist the tendency to sag and to contact the food product in the container, and to provide a container which is easily and economically manufactured in blank form and then easily assembled by the user.

The following patents are typical of the prior art relative to this invention: U.S. Pat. Nos. 3,163,344; 3,428,103; 3,442,433; 3,512,697; 3,650,383; 3,721,803; 3,923,234; 4,195,746; 4,201,301; 4,355,757; 4,360,107; 4,360,118; 4,373,636; 4,376,558; 4,441,626; 4,476,989; 4,567,341; 4,819,862; 4,836,383; 4,848,543; 4,877,609; 4,883,195; 4,886,179; 4,891,482; 4,919,326; 4,922,626; Des. 274,889; Des. 292,176; Des. 306,405; and Des. 307,243.

DESCRIPTION OF INVENTION

The present invention generally relates to a six-sided container for a flat food product, such as pizza pie, and to a one-piece blank which can be selectively folded to assemble the container. More particularly, the invention relates to a uniquely designed container having a minimum of airspace so as to maintain the temperature of hot or warm food products within the container.

In accordance with the present invention, the container is provided with a "lock tab" design for securing and locking the side panels of the container into an upright position relative to the base of the container. This capability is achieved by the provision of lock tabs located on minor flaps of the front base panel of the container, such lock tabs being inserted, during assembly of the container, into corresponding slots located in extending portions of the side panel when the latter is in the upright position. This design is superior to other "lock tab" designs in that it is easy to assembly and yet provides a strong interlocking between the front base panel and the adjacent side panels. Moreover, the "lock tab" design of the present invention is superior to prior art designs in that the "lock tab" design of the present invention provides additional support for the top of the container, thereby preventing sagging of the top and resultant contact with the food product in the container below.

In accordance with a further feature of the invention, when the container blank is manufactured, perforated portions are provided between adjacent side panels of the container so that, when the blank is assembled into a container by the user, the perforated portions automatically provide hot air ventilation outlets for ventilating the container when it is holding warm or hot food products. Further advantageous characteristics of the inventive container include the following: friction locking between the rear side panels of the container, on the one hand, and the rear panel of the container, on the other hand; support of the top of the container when in the closed position by the side panels, thereby preventing the closed top from sagging and contacting the food product in the container; nesting of the base and top in an inverted fashion, thereby providing savings in corrugated material over conventional containers while accommodating the same size food product as the conventional containers; and provision of a front truck on the front, and/or tab-like portions on the sides, of the top for providing a more complete closing of the container. Therefore, it is a primary object of the present invention to provide a container and/or blank suitable for packaging of a flat food product, such as pizza pie.

It is an additional object of the present invention to provide a container having a unique six-sided design which affords less airspace in the container than in conventional containers, thereby facilitating maintenance of the temperature of the food product therein.

It is an additional object of the present invention to provide a container having a "lock tab" feature for securing or interlocking the side panels into an upright position relative to the base of the container.

It is an additional object of the present invention to provide a container having perforated portions located between adjacent side panels so as to provide for contiguous side panels while automatically providing hot air ventilation outlets when the container is assembled.

It is an additional object of the present invention to provide a container having side panels, the rear portions of which are friction locked into place by contact with the rear panel of the container.

It is an additional object of the present invention to provide a container having a base and a top which are designed to be nested in an inverted (base to top) fashion, thereby achieving savings in material for manufacturing the container.

It is an additional object of the present invention to provide a container having a top which has a front tuck on the front, and/or tab-like portions on the sides, thereby facilitating complete closing of the container.

The above and other objects, and the nature of the invention, will be more clearly understood by reference to the following detailed description, the related drawings, and the appended claims.

BEST MODE FOR CARRYING OUT THE INVENTION

The invention will now be described in more detail with reference to the following detailed description and the associated drawings.

Figure 1:
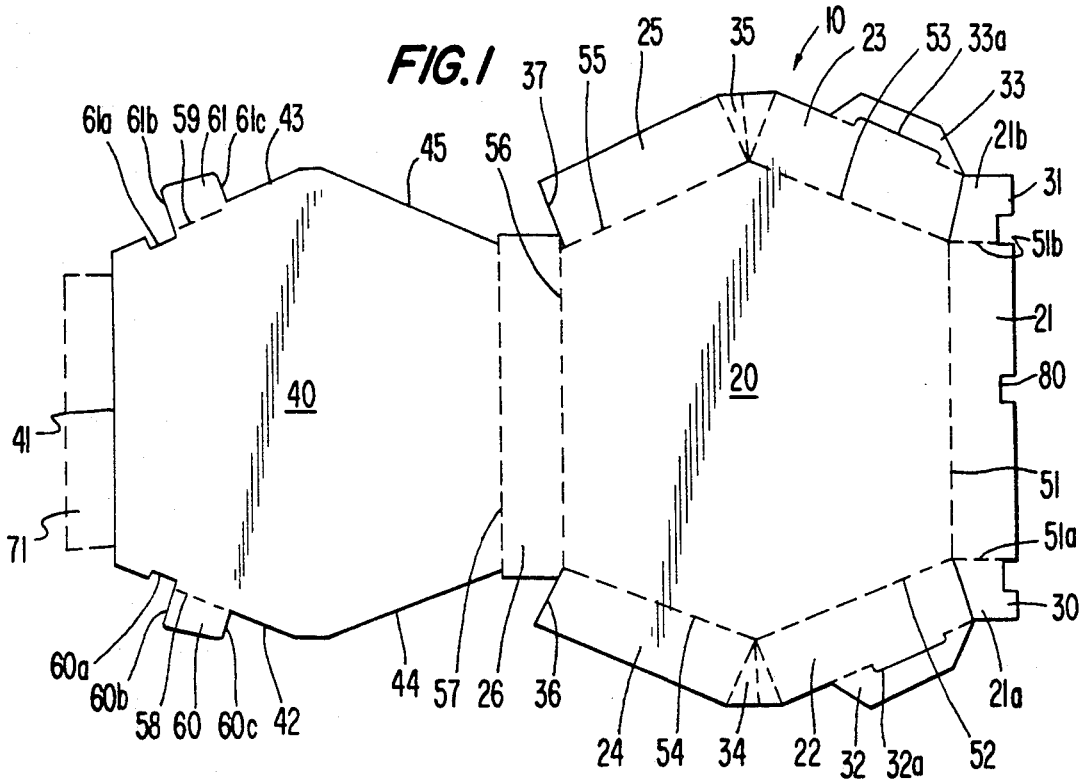
FIG. 1 is a plan view of a container blank which is used to form the container of the present invention.

FIG. 1 is a plan view of a container blank used to form the container of the present invention. As seen therein, the container blank or container 10 comprises a base 20 and a top 40. The base 20 comprises the following elements: front panel 21, opposing front side panels 22 and 23, opposing rear side panels 24 and 25, and rear panel 26.

Front panel 21 has minor flaps 21*a* and 21*b*, the flaps 21*a* and 21*b* being provided with lock tabs 30 and 31 formed in the outer perimeter thereof. A folding score 51 separates the front panel 21 from the remainder of the base 20, while folding scores 51*a* and 51*b* separate the major portion of the front panel 21 from minor flaps 21*a* and 21*b*, respectively. A notch 80 is, preferably, formed in the outer perimeter of the front panel 21 and serves, when the container 10 is assembled, to facilitate opening of the container as well as ventilation of the container.

Front side panels 22 and 23 are separated from the remainder of the container by folding scores 52 and 53, respectively. In addition, outermost portions 32 and 33 of the side panels 22 and 23 have slits 32*a* and 33*a*, respectively, formed therein. As discussed in more detail below, the slits 32*a* and 33*a* are engaged by other components of the assembled container to secure the side panels 22–25 in an upright position and to secure the top 40 in a closed position.

Rear side panels 24 and 25 are separated from the remainder of the container by folding scores 54 and 55, respectively. Side panels 24 and 25 have rear portions 36 and 37, respectively, which rear portions 36 and 37 are angle-cut (i.e., cut at angles), so that the portions 36 and 37 engage the rear panel 26 when the container 10 is in its assembled and closed condition, thereby providing the container 10 with a "friction lock" feature.

A perforated portion 34 is formed between side panels 22 and 24, and similarly a perforated portion 35 is formed between side panels 23 and 25. Perforated portions 34 and 35 are formed by the placement of two sets of three folding scores each in the corrugated material located between side panels 22 and 24 and between side panels 23 and 25, respectively, as shown in FIG. 1.

Rear panel 26 is separated from the remainder of the base 20 by folding score 56, and is separated from the top 40 by folding score 57.

The top 40 basically comprises sides 41–45. Sides 42 and 43 have tab-like portions 60 and 61, respectively, formed therein, each tab-like portion 60 and 61 being separated from the remainder of the top 40 by folding scores 58 and 59, respectively. Tab-like portions 60 and 61 have respective front edges 60*b* and 61*b* and respective rear edges 60*c* and 61*c* which are "angled", that is, front edges 60*b* and 61 *b* form angles slightly less than 90° with respective folding scores 58 and 59, while respective rear edges 60*c* and 61*c* form angles slightly greater than 90° with respective folding scores 58 and 59. In addition, notches 60*a* and 61*a* are formed in sides 42 and 43, respectively, adjacent to and to the front of the portions 60 and 61, respectively.

As an option, a front tuck portion 71 may be formed on side 41 of the top 40. The portion 71 facilitates complete closing of the container when in its assembled condition, as will be explained below.

The assembly and use of the container 10 of the present invention will now be described with further reference to FIG. 2, which is a perspective view of the container 10 in its "open" position, and with reference to FIG. 3, which is a perspective view of the container 10 in its "partially closed" position.

Figure 2:
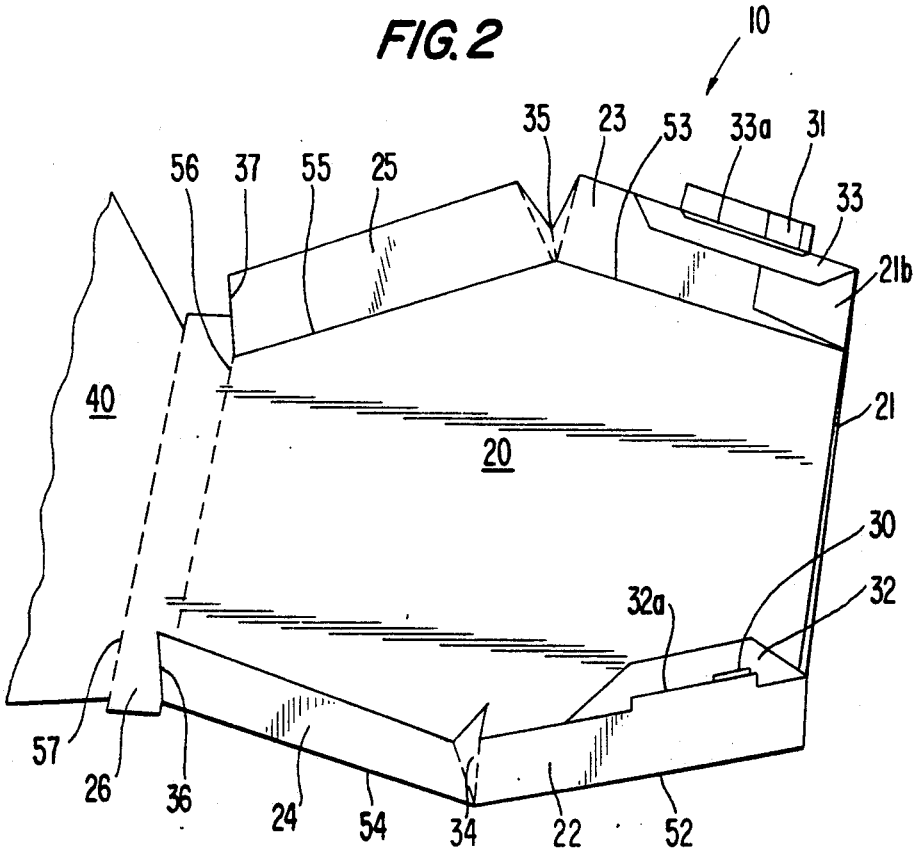
FIG. 2 is a perspective view of the container of the present invention in its "open" position.

As seen in FIG. 2, assembly of the container 10 begins with assembly of the base 20 thereof. The base 20 is assembled by folding side panels 22–25 along corresponding folding scores 52–55, thereby raising the side panels 22–25. As the side panels 22–25 are raised, perforated portions 34 and 35 are folded so as to assume a V-shaped configuration, with the convex or pointed portion of the V configuration pointing inward, as shown in FIG. 2.

Continuing with the assembly of base 20, the front panel 21 is raised by folding along folding score 51, the minor flaps 21*a* and 21*b* being folded inwardly along folding scores 51*a* and 51*b*, respectively, as the front panel 21 is raised. At the same time, the outermost portions 32 and 33 of side panels 22 and 23, respectively, are folded inward, thereby exposing horizontally oriented slits 32*a* and 33*a*, respectively.

In accordance with the "lock tab" feature of the present invention, as front panel 21 is raised to its fully vertical position, minor flaps 21*a* and 21*b* of the front panel are rotated inwardly toward the interior of the base 20, so that lock tabs 30 and 31 fall under the slits 32*a* and 33*a*, respectively, of the side panels 22 and 23, respectively. Moreover, when side panels 22 and 23 are folded into their fully vertical position, lock tabs 30 and 31 of the front panel 21 become seated in the slits 32*a* and 33*a*, respectively, thus securing front panel 21 and side panels 22–25 into an upright position. This "lock tab" feature of the present invention permits the flat food product to be placed into the base 20 of the container 10 via the rear end of the base 20 (that is, via the opening adjacent to rear panel 26). In addition, this "lock tab" design provides support for the top 40, thereby preventing sagging of the top 40 and consequent undesired contact between the top 40 and the food product in the container 10.

Figure 3:
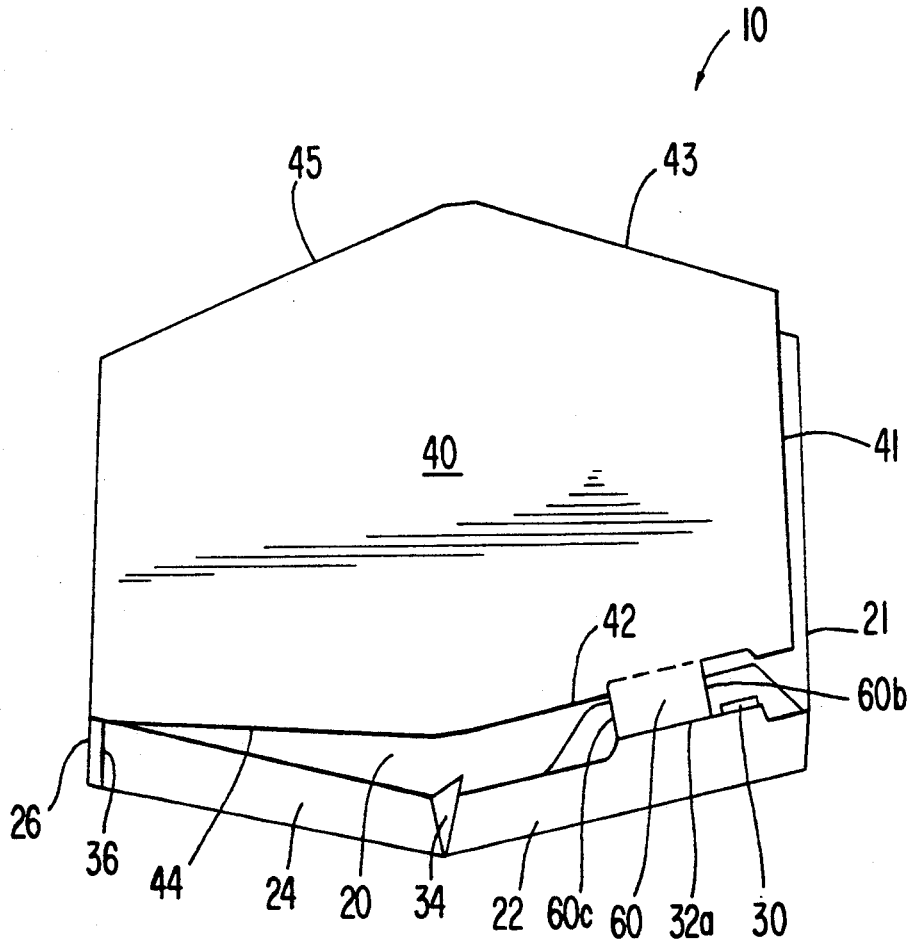
FIG. 3 is a perspective view of the container of the present invention in its "partially closed" position, illustrating the "lock tab" feature of the present invention.

Referring to FIG. 3, the operation of closing the container 10 will now be described. Once the base 20 of the container 10 is assembled as described above, the tab-like portions 60 and 61 of the top 40 of the container 10 are folded along folding scores 58 and 59, respectively, and the top 40 is rotated forward over the base 20. In this manner, the tab-like portions 60 and 61 are inserted into slits 32*a* and 33*a*, respectively, that is, in the portions of slits 32*a* and 33*a* not occupied by lock tabs 30 and 31, respectively, of the front panel 21. As a result of the seating of tab-like portions 60 and 61 in slits 32*a* and 33*a*, respectively, the top 40 is closed over and secured to the base 20 and side panels 22-25.

As mentioned above, the top 40 (FIG. 1) is provided with notches 60*a* and 61*a* located to the front (left in FIG. 1) of the tab-like portions 60 and 61, respectively. When the cover 40 is closed over the base 20, these notches 60*a* and 61*a* serve as an offset to accommodate the lock tabs 30 and 31, respectively, of front wall 21, as such lock tabs 30 and 31 are protruding from the slits 32*a* and 33*a*, respectively.

It should be noted that, prior to rotating the top 40 forward over the base 20, top 40 is folded relative to rear panel 26 via folding score 57, and the rear panel 26 is folded relative to base 20 via folding score 56. Thus, as the top 40 is rotated forward over the base 20, the rear panel 26 is raised to a fully vertical position. As mentioned above, rear portions 36 and 37 of side panels 24 and 25, respectively, are "angle cut", that is, portions 36 and 37 are inclined toward the rear panel 26. Thus, when the rear panel 26 is raised to a fully vertical position, portions 36 and 37 are pressed inwardly by rear panel 26, and this results in the "friction locking" of side panels 24 and 25 in place by rear panel 26. That is to say, by virtue of this "friction locking" feature, side panels 24 and 25 are secured and locked in place as a result of the closing of the top 40 of container 10. Moreover, the combination of the "friction locking" feature with the previously described "lock tab" feature results in the closed container having side panels 22-25 rigidly locked into an upright position.

The locking of side panels 22-25 into the upright or vertical position is an important function because, once the top 40 is in its fully closed position, the top 40 rests on side panels 22-25, and it is the rigidly secured side panels 22-25 which support the top 40 and prevent it from sagging and contacting the food product in the interior of the container 10.

The fact that the angle-cut rear portions 36 and 37 of side panels 24 and 25, respectively, bear against the rear panel 26 when it is raised into a fully vertical position provides a further advantage. Specifically, the side panel forces exerted on rear panel 26, and thus on top 40, tend to pull the tab-like portions 60 and 61 of top 40 to the rear as they are seated in the slits 32*a* and 33*a*, respectively. This creates a friction-type resistance between tab-like portions 60 and 61 and slits 32*a* and 33*a*, respectively, which resistance opposes lifting of the top 40. Moreover, the "angled" design of tab-like portions 60 and 61 discussed above results in the occurrence of friction between respective rear edges 60*c* and 61*c* and the rear edges of respective slits 32*a* and 33*a* as the top 40 is closed over base 20, and this contributes to the friction-type resistance just mentioned. Thus, the top 40 is friction-locked into its covering position with respect to the base 20.

It will be recalled from the discussion above that, as the base 20 is assembled as shown in FIG. 2, perforated portions 34 and 35 are folded inwardly. Thus, side panels 22 and 24 and side panels 23 and 25—which are contiguous when the container 10 is in its "blank" stage (as seen in FIG. 1)—remain contiguous as the base 20 is assembled (as seen in FIG. 2). Furthermore, the perforated portions 34 and 35 are so dimensioned that, as folding takes place during the assembly of base 20, the top portions of the V configuration of the perforated portions 34 and 35 are inclined slightly downward (as seen in FIG. 3). As a result, once the top 40 is completely closed, a small air hole or space exists between the top of each perforated portion 34 and 35 and the bottom surface of top 40. These spaces—automatically formed during assembly of the container 10—provide the container 10 with hot air ventilation outlets. These hot air ventilation outlets are an obvious advantage when the food product in the container 10 is a warm or hot food product.

It should be noted that the base 20 and top 40 are designed to be nested in an inverted (base to top) fashion. This feature provides a savings in corrugated material over conventional rectangular containers that accommodate the same size food product.

More specifically, taking the example of "two-out" production (i.e., production of two blanks at a time), two conventional rectangular containers can be produced from a blank measuring 37 inches by 37.5 inches for a total area of approximately 1388 square inches. In contrast, the unique six-sided design of the present invention results in the ability to produce two six-sided containers from a blank measuring 33.875 inches by 36.1875 inches for a total area of approximately 1226 square inches. Thus, for "two-out" production, the unique six-sided design of the present invention results in a savings of approximately 11.67 percent in material used. Moreover, the savings are compounded as the number "out" (i.e., the number of containers per sheet) is increased.

As mentioned earlier, as an option, the top 40 may be provided with a front tuck portion 71 (seen in FIG. 1). During the closing of the container 10, as described with reference to FIG. 3, the portion 71 would tuck behind (that is, on the interior side of) front panel 21. This feature provides a slightly more stable or secure closing of the container 10.

As also mentioned earlier, front panel 21 can be provided with a centered notch 80 (seen in FIG. 1). When the container 10 is closed (as seen in FIG. 3), the notch 80 can serve as a further hot air ventilation outlet when no front tuck 71 is provided on the top 40 (FIG. 1). In either event (that is, regardless of whether or not a front tuck 71 is provided), the notch 80 serves as an access point for insertion of the user's finger, thereby facilitating opening of the container 10 once the food product arrives at its destination.

It should be noted that the container 10 described above can be constructed of C, B or E flute corrugated materials, or any other fiberboard, chipboard or paperboard materials. The container 10 described above is designed to accommodate any size of food product (for example, pizza pies of any size —8-inch, 16-inch, and so forth). All folding scores 51, 51*a*, 51*b* and 52–59 described above may be regular scores, perforations of any type, or knife with knicks added. Moreover, the perforations established to form perforated portions 34 and 35 described above may be cut or creased in any fashion necessary to render the box functional in accordance with the above description.

While preferred forms and arrangements have been shown in illustrating the invention, it is to be understood that various changes in detail and arrangement may be made without departing from the spirit and scope of this disclosure.

I claim:

1. A container for a flat food product, comprising a front panel and two opposing side panels, said front panel having first and second minor flaps provided with respective tabs which extend upward when said front panel is vertically oriented, each of said two opposing side panels having a portion which is horizontally foldable along a generally horizontal line and a slit disposed along said generally horizontal line, each of said respective tabs being inserted in and received by a slit of a respective one of said two opposing side panels when said front panel and said two opposing side panels are vertically oriented, thereby locking said front panel and said two opposing side panels in vertically oriented positions;

wherein said container includes a top which overlies said container when said top is in a closed position, said top having two opposing sides which overlie said two opposing side panels of said container when said top is in the closed position, each of said two opposing sides of said top having a tab-like portion formed therein; and wherein, when said top is moved into the closed position, each of said tab-like portions is inserted into said slit of a respective one of said two opposing side panels and frictionally engages said respective tab of a respective one of said first and second minor flaps, whereby said respective tabs of said first and second minor flaps cooperate with respective said tab-like portions to secure said top in the closed position.

2. The container of claim 1, wherein each of said tab-like portions has a front edge which is angularly oriented so as to frictionally engage a corresponding rear edge of said respective tab of said first and second minor flaps when said top is moved into a closed position.

3. The container of claim 2, wherein each of said tab-like portions is separated from said top by a perforated line, and each of said front edges forms an angle less than 90° relative to the perforated line of a respective one of said tab-like portions.

4. A container for a flat food product, comprising a front panel and two opposing side panels, said front panel having first and second minor flaps provided with respective tabs which extend upward when said front panel is vertically oriented, each of said two opposing side panels having a portion which is horizontally foldable along a generally horizontal line and a slit disposed along said generally horizontal line, each of said respective tabs being inserted in and received by a slit of a respective one of said two opposing side panels when said front panel and said two opposing side panels are vertically oriented, thereby locking said front panel and said two opposing side panels in vertically oriented positions;

wherein said container comprises two additional opposing side panels, each additional opposing side panel being disposed on a side of a respective one of said two opposing side panels remote from said front panel; and wherein each additional opposing side panel is connected to said respective one of said two opposing side panels by a respective perforated portion;

wherein said container includes a top which overlies said container when said top is in a closed position, and wherein each said respective perforated portion has a top edge which is separated from said top of said container when said top is in the closed position and when said front panel and said two opposing side panels are vertically oriented, thereby forming a corresponding air ventilation outlet for said container.

5. The container of claim 4, wherein said top edge of each said respective perforated portion is inclined angularly with respect to a horizontal reference direction when said front panel and said opposing side panels are vertically oriented.

6. The container of claim 4, wherein each of said two additional opposing side panels has a rear portion remote from said respective one of said two opposing side panels, said container including a rear panel extending between said rear portions of said two additional opposing side panels, said top having a rear side connected to said rear panel and a front side, said top being foldable at said rear side so as to cover said container by lying over and resting on said two opposing side panels and said two additional side panels.

7. The container of claim 6, said container including a front tuck portion connected to said front side of said top, said front tuck portion being foldable at said front side so as to be inserted inside of said front panel when said top covers said container.

8. The container of claim 6, wherein said top has two opposing sides extending between said rear side and said front side of said top, each of said two opposing sides of said top having a tab-like portion formed therein, each of said tab-like portions being foldable so as to be inserted into said slit of a respective one of said opposing side panels when said top covers said container, thereby securing said top in a covering position.

9. The container of claim 4, wherein said top has a front side and a rear side extending between said two additional opposing side panels when said top is in a closed position, said container including a front tuck portion connected to said front side of said top, said front tuck portion being foldable at said front side of said top so as to be inserted inside of said front panel when said top covers said container.

10. The container of claim 4, wherein said top has a front side and a rear side extending between said two additional opposing side panels, said top having two opposing sides extending between said rear side and said front side of said top, each of said two opposing sides having a tab-like portion formed therein, each of said tab-like portions being foldable so as to be inserted into said slit of a respective one of said two opposing side panels when said top covers said container, thereby securing said top in a covering position.

11. A container for a flat food product, comprising a front panel and two opposing side panels, said front panel having first and second minor flaps provided with respective tabs which extend upward when said front panel is vertically oriented, each of said two opposing side panels having a portion which is horizontally foldable along a generally horizontal line and a slit disposed along said generally horizontal line, each of said respective tabs being inserted in and received by a slit of a respective one of said two opposing side panels when said front panel and said two opposing side panels are vertically oriented, thereby locking said front panel and said two opposing side panels in vertically oriented positions;

wherein said container comprises two additional opposing side panels, each additional opposing side panel being disposed on a side of a respective one of said two opposing side panels remote from said front panel; and wherein each of said two additional opposing side panels has a rear portion which is inclined angularly with respect to a vertical reference direction when said front panel and said two opposing side panels are vertically oriented, said container including a rear panel which extends between said rear portions of said two additional opposing side panels, said rear panel pressing against said rear portions of said two additional opposing side panels when said rear panel is vertically oriented, thereby locking said two additional opposing side panels in vertically oriented positions.

12. A container for a flat food product, comprising a front panel, first and second opposing side panels adjacent to said front panel, third and fourth opposing side panels adjacent to said first and second opposing side panels, respectively, and first and second perforated portions interconnecting said first and third opposing side panels and said second and fourth opposing side panels, respectively, said container including a top, and wherein each of said first and second perforated portions has a top edge which is separated from said top of said container when said top overlies said front panel and said first, second, third and fourth opposing side panels, thereby forming respective first and second air ventilation outlets for said container.

13. The container of claim 12, wherein said top edge of each of said first and second perforated portions is inclined angularly with respect to a horizontal reference direction when said front panel and said first, second, third and fourth opposing side panels are generally vertically oriented.

14. A container for a flat food product, comprising, a front panel, a rear panel, and two opposing side panels extending from said front panel to said rear panel, wherein each of said two opposing side panels has a rear portion which is inclined angularly with respect to a vertical reference direction when said front panel and said two opposing side panels are vertically oriented, said rear panel pressing against said rear portions of said two opposing side panels when said rear panel is vertically oriented, thereby locking said two opposing side panels in vertically oriented positions.

15. The container of claim 14, wherein said front panel includes securing means for securing said front panel to said two opposing side panels.

16. The container of claim 15, wherein said front panel has first and second minor flaps, and said securing means comprises first and second lock tabs positioned on respective ones of said first and second minor flaps of said front panel adjacent a respective one of said two opposing side panels, said two opposing side panels being provided with respective portions which are horizontally foldable along a generally horizontal line and a slit disposed along said generally horizontal line, each of said respective lock tabs being inserted in and received by a slit of a respective one of said portions of said two opposing side panels.

17. The container of claim 16, further comprising a top having two opposing sides, each opposing side of said top having a tab-like portion formed therein, each of said tab-like portions being foldable so as to be inserted into said slit of a respective one of said two opposing side panels when said top covers said container, thereby securing said top in a covering position.

18. The container of claim 14, further comprising a top and securing means for securing said top to said two opposing side panels.

19. The container of claim 18, wherein said securing means comprises first and second tab-like portions formed on respective sides of said top, each of said two opposing side panels having a portion which is horizontally foldable along a generally horizontal line and a slit disposed along said generally horizontal line, each of said tab-like portions of said top being inserted in and received by a respective slit of said two opposing side panels when said front panel and said two opposing side panels are vertically oriented, thereby securing said top in a covering position.

20. A container for a flat food product, comprising a front panel, a rear panel, two opposing side panels extending from said front panel to said rear panel, a top connected to said rear panel, and securing means for securing said top to said two opposing side panels when said container is in a closed position, wherein said securing means comprises first and second tab-like portions formed on respective sides of said top;

wherein each of said two opposing side panels has a portion which is horizontally foldable along a generally horizontal line and a slit disposed along said generally horizontal line, each of said tab-like portions of said top being inserted in and received by a respective slit of said two opposing side panels when said front panel and said two opposing side panels are vertically oriented; and wherein each of said tab-like portions is separated from said top by a respective perforated line, and each of said tab-like portions has a rear edge oriented at an angle greater than 90° relative to said respective perforated line so that each of said rear edges frictionally engages a corresponding rear portion of said respective slit when said to p is closed, whereby friction-type resistance to opening of said top is achieved.

21. A one-piece blank adapted to be selectively folded to form a container for a flat food product, said blank comprising a front panel and two opposing side panels, said front panel having first and second end portions formed into respective tabs which extend upward when said front panel is vertically oriented, each of said two opposing side panels having a portion which is horizontally foldable along a generally horizontal line and a slit disposed along said generally horizontal line, each of said respective tabs being inserted in and received by a slit of a respective one of said two opposing side panels when said front panel and said two opposing side panels are folded into a vertical orientation, thereby locking said front panel and said two opposing side panels in vertical orientation;

wherein said blank includes a top which overlies said container when said top is in a closed position, said top having two opposing sides which overlie said two opposing side panels of said container when said top is in the closed position, each of said two opposing sides of said top having a tab-like portion formed therein; and wherein, when said top is moved into the closed position, each of said tab-like portions is inserted into said slit of a respective one of said two opposing side panels and frictionally engages said respective tab of a respective one of said first and second minor flaps, whereby said respective tabs of said first and second minor flaps cooperate with respective said tab-like portions to secure said top in the closed position.

22. The blank of claim 21, wherein said blank comprises two additional opposing side panels, each additional opposing side panel being disposed on a side of a respective one of said two opposing side panels remote from said front panel.

23. The blank of claim 22, further comprising a rear panel extending between rear portions of said two additional opposing side panels, said top having a rear side connected to said rear panel and a front side, said top being foldable at said rear side so as to cover said container.

24. The blank of claim 23, wherein said two opposing sides of said top extend between said rear side and said front side of said top, each of said tab-like portions being foldable so as to be inserted into said slit of a respective one of said two opposing side panels when said top covers said container.

25. The blank of claim 21, further comprising a rear panel connected to said top, wherein said top has a front side and a rear side connected to said rear panel, said two opposing sides extending between said rear side and said front side, each of said tab-like portions being foldable so as to be inserted into said slit of a respective one of said two opposing side panels when said top covers said container.

26. The container of claim 21, wherein each of said tab-like portions has a front edge which is angularly oriented so as to frictionally engage a corresponding rear edge of said respective tab of said first and second minor flaps when said top is moved into a closed position.

27. The container of claim 26, wherein each of said tab-like portions is separated from said top by a perforated line, and each of said front edges forms an angle less than 90° relative to the perforated line of a respective one of said tab-like portions.

28. A one-piece blank adapted to be selectively folded to form a container for a flat food product, said blank comprising a front panel, first and second opposing side panels adjacent to said front panel, third and fourth opposing side panels adjacent to said first and second opposing side panels, respectively, and first and second perforated portions interconnecting said first and third opposing side panels and said second and fourth opposing side panels, respectively, said blank including a top, and wherein each of said first and second perforated portions has, when folded into a generally vertical orientation, a top edge which is separated from said top when said top overlies said front panel and said first, second, third and fourth opposing side panels, thereby forming respective first and second air ventilation outlets for said container.

29. The blank of claim 28, wherein said top edge of each of said first and second perforated portions is inclined angularly with respect to a horizontal reference direction when said first and second perforated portions are folded into said generally vertical orientation.

30. A one-piece blank adapted to be selectively folded to form a container for a flat food product, said blank comprising a front panel, a rear panel, and two opposing side panels extending from said front panel to said rear panel, wherein each of said two opposing side panels has a rear portion which is inclined angularly with respect to a vertical reference direction when said front panel and said two opposing side panels are folded into a vertical orientation, said rear panel pressing against said rear portions of said two opposing side panels when said rear panel is folded into a vertical orientation, thereby locking said two opposing side panels in vertically oriented positions.

31. The blank of claim 30, wherein said front panel includes first and second minor flaps and first and second lock tabs positioned on respective ones of said first and second minor flaps of said front panel adjacent a respective one of said two opposing side panels, said two opposing side panels being provided with respective portions which are horizontally foldable along a generally horizontal line when said two opposing side panels are folded into a vertical orientation, said two opposing side panels also being provided with a slit disposed along said generally horizontal line, each of said respective lock tabs being inserted in and received by a slit of a respective one of said portions of said two opposing side panels when said blank is selectively folded, thereby securing said front panel to said two opposing side panels.

32. The blank of claim 30, further comprising a top connected to said rear panel, wherein first and second tab-like portions are formed on respective sides of said top, each of said two opposing side panels having a portion which is horizontally foldable along a generally horizontal line when said two opposing side panels are folded into a vertical orientation, said two opposing side panels having a slit disposed along said generally horizontal line, each of said tab-like portions of said top being inserted in and received by a respective slit of said two opposing side panels when said front panel and said two opposing side panels are vertically oriented, thereby securing said top in a covering position.

33. A one-piece blank adapted to be selectively folded to form a container for a flat food product, said blank comprising a front panel, a rear panel, two opposing side panels extending from said front panel to said rear panel, a top connected to said rear panel, and securing means for securing said top to said two opposing side panels when said container is in a closed position, wherein said securing means comprises first and second tab-like portions formed on respective sides of said top;

wherein each of said two opposing side panels has a portion which is horizontally foldable along a generally horizontal line and a slit disposed along said generally horizontal line, each of said tab-like portions of said top being inserted in and received by a respective slit of said two opposing side panels when said front panel and said two opposing side panels are folded into a vertical orientation; and wherein each of said tab-like portions is separated from said top by a respective perforated line, and each of said tab-like portions has a rear edge oriented at an angle greater than 90° relative to said respective perforated line so that each of said rear edges frictionally engages a corresponding rear portion of said respective slit when said top is closed, whereby friction-type resistance to opening of said top is achieved.

* * * * *